United States Patent [19]

Morro et al.

[11] 4,059,534

[45] Nov. 22, 1977

[54] HYDROCARBON/SILICON OIL LUBRICATING COMPOSITIONS FOR LOW TEMPERATURE USE

[75] Inventors: William Charles Morro, Montreal; Leo Ernest Hakka, Dollard des Ormeaux; James Mackay Brophy, Dorval; Michel Jacques Roger Hebrard, Montreal Nord; Jean Claude Courtes, Chomedy Laval, all of Canada

[73] Assignee: Union Carbide Canada Limited, Toronto, Canada

[21] Appl. No.: 674,346

[22] Filed: Apr. 7, 1976

[51] Int. Cl.[2] ..... C10M 1/50

[52] U.S. Cl. ..... 252/32.7 E; 252/49.6; 252/52 R; 252/32.7 R; 252/52 A

[58] Field of Search ..... 252/49.6, 32.7 E, 32.7 R, 252/52

[56] References Cited

U.S. PATENT DOCUMENTS

| | | | |
|---|---|---|---|
| 2,467,178 | 4/1949 | Zimmer et al. | 252/49.9 |
| 2,828,836 | 2/1958 | Smith et al. | 252/32.7 R |
| 3,175,995 | 3/1965 | Elliott et al. | 252/49.6 |
| 3,269,946 | 8/1966 | Wiese | 252/32.5 |
| 3,269,949 | 8/1966 | Borg | 252/49.6 |
| 3,600,327 | 8/1971 | Hu | 252/32.7 |
| 3,609,079 | 9/1971 | Devine et al. | 252/49.6 |

FOREIGN PATENT DOCUMENTS

| | | |
|---|---|---|
| 1,224,885 | 3/1971 | United Kingdom |

*Primary Examiner*—Arthur P. Demers

[57] ABSTRACT

A low temperature lubricant oil composition having improved viscosity-temperature properties, lubricating properties and pour point is described. The composition comprises a homogeneous mixture of from 1% to 50% by weight of poly(dimethylsiloxane) having an average viscosity at 100° F between 100,000 cs and 1,000,000 cs, the remainder of the mixture being a hydrocarbon oil selected from certain alkenes, isoparaffins and naphthenics. The composition can also contain a foam inhibitor such as a perfluoroalkylpolyether.

29 Claims, No Drawings

HYDROCARBON/SILICON OIL LUBRICATING COMPOSITIONS FOR LOW TEMPERATURE USE

This invention relates to low temperature lubricant compositions having improved viscosity-temperature properties, lubricating properties, and pour point, containing a solvent oil, poly(dimethylsiloxane), and certain antiwear and foam inhibiting additives.

Lubricating oil compositions are often employed as functional fluids, power transmission fluids, or heat transfer fluids, such as in automatic transmissions, pumps, and hydraulic equipment. Most equipment of this sort is rendered inoperable if the viscosity of the functional fluid changes dramatically between extremes of operating temperature. The problem is particularly acute in arctic regions where the ambient temperature can range from −75° to 100° F, and the operating temperature of the equipment may vary from −75° F to 300° F; similar operational temperature ranges are frequently encountered in heat exchange equipment.

In order to achieve the required viscosity stability (high viscosity index) the fluids are provided with additives such as polyalkyl methacrylate polymers and copolymers, polyisobutylenes, polyalkyl styrenes, and copolymers of methacrylates or fumaric-acid esters with polar monomers; typical of the last type is vinyl pyrrolidine. These addtives, however, are not always completely satisfactory; in many cases their thermal stability, stability under load, or both, are insufficient to provide the modified fluid with an extended or useful life.

Where conventional viscosity index improvers have not have successful in providing adequate viscosity index along with other properties, common practice has been to operate equipment continually to maintain the operating temperature, or to frequently change the fluid to conform with changing ambient conditions and operating temperature. Clearly, such routes are economically and conservationally unsound.

It is well known that certain liquid poly(organosiloxanes) exhibit a very high viscosity index which enables them to be used as functional fluid over a broad temperature range. Poly(dimethylsiloxane) in particular, shows a performance in this area which is superior to virtually all known materials. Unfortunately, these so-called silicone oils, especially poly(dimethylsiloxane), are incompatible with most other materials and are economically unattractive; moreover, they have poor lubricating properties when used as lubricants for metal on metal, particularly steel on steel applications. Their incompatibility makes it difficult to improve their performance with additives.

In order to take advantage of the good viscosity-temperature properties of silicone oils, it is desirable to dissolve them in lubricating oil carriers. This has been carried out with various poly(organo-siloxanes) as described in German Pat. No. 1,806,445. However, the solubility characteristics of poly(dimethylsiloxane) generally prevent its dispersion in liquid media, except with the aid of dispersing agents or emulsifiers, such as described in U.S. Pat. No. 3,445,385 and U.S. Pat. No. 2,466,642.

It is well known that the higher the molecular weight of the polymer or solvent, the more difficult it becomes to effect dissolution. Thus, in those few cases where poly(dimethylsiloxane) oil has been successfully incorporated into a homogeneous composition, the molecular weight of the silicone has been such that its viscosity has been limited to around 1,00 cs or less as shown in U.S. Pat. No. 2,652,364 and U.S. Pat. No. 2,618,601. The solubility characteristics, viscosity-temperature behaviour, and lubricating properties of such low molecular weight polymers of dimethylsiloxane are markedly different from those exhibited by the higher liquid polymers. In fact, it is generally accepted that high polymers of any polymeric material possess very different properties from their lower molecular weight counterparts. Clearly, the behaviour of plastic polyethylene cannot be predicted from the properties of hexane or octane. It has been the experience of workers in the field that solutions of high viscosity (i.e. high molecular weight) poly(dimethylsiloxane) are temperature sensitive, and solution components separate at temperatures significantly above those at which lower polymers become incompatible. For this reason, it has, heretofore, been impossible to utilize hydrocarbon lubricants containing significant amounts of high viscosity dimethyl silicone oil in applications where even nominally low temperatures are encountered.

It is an object of this invention to provide a low temperature lubricant oil composition containing poly(dimethylsiloxane) having a relatively high viscosity, said composition exhibiting good lubricity and pour point characteristics.

In one aspect of this invention there is provided a homogeneous composition comprising a hydrocarbon liquid and poly(dimethylsiloxane) having a viscosity between 10,000 cs and 1,000,000 cs.

It is therefore an object of the invention to provide a lubricating oil composition comprising a homogeneous mixture of from 1% to 50% by weight of (A) poly(dimethylsiloxane) having the general formula:

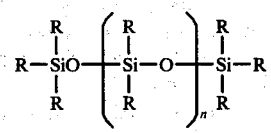

When R is a methyl group in essentially all cases and $n$ has a value such that the average viscosity of the poly(dimethylsiloxane) at 100° F is between 10,000 cs and 1,000,000 cs, and the remainder of said mixture consisting of (B) hydrocarbon oil having a viscosity of less than 40,000 cs at −65° F, and a flashpoint higher than 175° F, and said hydrocarbon oil being at least one selected from the group consisting of (a) alkenes, (b) isoparaffins, and (c) naphthenics having a single ring which has multiple alkyl substituents, in the case of (a) and (b), the longest carbon chain, and in the case of (c) any alkyl substituent in which the longest carbon chain exceeds five carbon atoms, has multiple substituent alkyl branches, and its methyl branched homolog has a solubility parameter of less than 7.84 and said substituent alkyl branches of four or more carbon atoms are themselves branched, and where at least 50% of said substituent alkyl branches are bonded to carbons of the longest carbon chain which are immediately adjacent, or separated by only one carbon atom.

It is another object of the invention to provide a process for effecting movement of a movable member within an enclosing member which comprises transmitting pressure to said movable member through a liquid medium consisting essentially of a lubricating oil composition as defined above.

It is still another object of the invention to provide a process for transmitting force through a hydraulic system having hydraulic activating means, an hydraulic line means connecting said hydraulic activating means to an hydraulic activated means, which process comprises substantially filling said hydraulic activating means, said hydraulic line means and said hydraulic activated means with a lubricating oil composition as defined above.

The lubricating oil compositions are a homogeneous admixture containing a hydrocarbon liquid and poly(dimethylsiloxane) in sufficient quantity to give the desired viscosity. More specifically, the homogeneous lubricating composition of the invention contains a hydrocarbon base oil, and from 1 to 50% by weight of a poly(dimethylsiloxane) of the general formula:

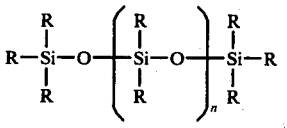

wherein R is a methyl group in essentially all of the cases, and *n* has values such that the viscosity of the poly(dimethylsiloxane) at 100° F is between 10,000 cs and 1,000,000 cs. More preferably, R is always a methyl group, and *n* has values such that the viscosity of the poly(dimethylsiloxane) at 100° F is between 100,000 cs and 500,000 cs and the poly(dimethylsiloxane) is present in the composition in concentrations from 2 to 15% by weight. It will be appreciated by those skilled in the art of polymer chemistry that in polymers of the size described above, the possibility exists that R might be other than a methyl group in one or more of the positions along the polymer chain. Some slight deviation from R being a methyl group in the poly(dimethylsiloxane) would therefore be acceptable without departing from the present invention so long as the extent of deviation does not significantly affect the viscosity, temperature behavior, or solubility. For this reason the formula given above is described wherein R is a methyl group in "essentially" all of the cases.

The hydrocarbon oil of the invention may be of either synthetic or natural origin, and is selected from the classes known as naphthenic, paraffinic, alkene, or a combination of these. By naphthenic species, we mean any non-aromatic ring structure comprised solely of carbon and hydrogen. By paraffinic species, we mean all those hydrocarbons that do not contain cyclic structures, or double or triple bonds. By alkene species, we include only those hydrocarbons not containing cyclic structures, but which contain non-conjugated double bonds.

The hydrocarbon oils of the invention should have a viscosity less than 40,000 cs at −65° F, and a flashpoint higher than 175° F.

More specifically, the paraffinic hydrocarbons must be multi-branched hydrocarbons, commonly known as iso-paraffins, wherein at least 50% of the primary branches are located on carbons which are immediately adjacent, or separated by only one carbon. We have also discovered that the degree and type of branching is critical to the solvent power of the isoparaffins. As a means of defining the degree of branching, the isoparaffins must have a structure such that, if all the primary branches are methyl groups (methyl branched homologues), the compound would have a Hildebrand solubility parameter less than 7.84 as calculated by the method described by R. F. Fedors in "Method for Estimating Both the Solubility Parameters and Molar Volume of Liquid" in the JPL Quarterly Technical Review Vol. 3, No. 1, April 1973, or as determined by experiment known in the art. While it is permissible for the primary branches to be higher alkyl groups, where they exceed 3 carbon atoms, they must also be branched, e.g. isobutyl radicals are acceptacle, whereas n-butyl radicals are not. Examples of petroleum distillates corresponding in large measure to this description include Esso Univolt 40, and Imperial Oil Isopar M products.

The entire range of the above described paraffins may correspond identically to, and may be obtained directly by hydrogenation of polymers, oligomers, or copolymers of hydrocarbons of 12 carbons or less. Said small hydrocarbons include ethylene, propylene, butenes, pentenes, hexenes, etc., and their saturated analogues.

Following are examples of compositions which include the described paraffins.

EXAMPLE I

15% by weight of poly(dimethylsiloxane), having a viscosity of 750,000 cs at 100° F, was dissolved in Esso Univolt 40, a petroleum oil fraction very high in isoparaffin content, which has a flashpoint of 210° F and viscosities of 750 cs and 1.4 cs at −65° F and 210° F respectively. The solubility parameter of the Univolt 40 was determined experimentally to be 7.5. The resulting composition was homogeneous at −65° F, and had viscosities of 8,792.2 cs and 53.9 cs at −65° F and 210° F

EXAMPLE 2

50% by weight of poly(dimethylsiloxane), having a viscosity of 10,000 cs at 100° F, was dissolved in Univolt 40. The resulting composition was homogeneous at −65° F, and had viscosities of 17,000 cs and 187.5 cs at −65° F and 210° F respectively.

EXAMPLE 3

10% by weight of poly(dimethylsiloxane), having a viscosity of 100,000 cs at 100° F was dissolved in 2,2,4,4,6,8,8 heptamethylnonane, a material obtainable by hydrogenating a random polymer of isobutylene. Other methods for the synthesis of this hydrocarbon also exist of course and are known to those skilled in the art. Heptamethylnonane has a flashpoint of 240° F, a solubility parameter of 7.42, and viscosities at −65° F and 210° F of 160 cs and 1.42 cs respectively. The resulting composition was homogeneous at −65° F, and had viscosities of 750 cs and 12.5 cs at −65° F and 210° F respectively.

EXAMPLE 4

10% by weight of poly(dimethylsiloxane), having a viscosity of 100,000 cs at 100° F, was dissolved in a cut of hydrogenated polyisobutylene that had a flashpoint of 260° F, a solubility parameter of 7.34, and viscosities at −65° F and 210° F of 1,150 cs and 1.8 cs respectively; the isobutylene polymer was formed exclusively by head to tail monomer addition. The resulting composition was homogeneous at −65° F, and had viscosities of 5,000 cs and 10.34 cs at −65° F, and 210° F respectively.

EXAMPLE 5

1% by weight of poly(dimethylsiloxane), having a viscosity of 100,000 cs at 100° F, was dissolved in Esso Univolt 40. The resulting composition was homogeneous at −65° F and had viscosities at −65° F and 210° F of 740 cs and 1.75 cs respectively.

The alkene hydrocarbons of the invention must have a structure such that their saturated analogous correspond to the suitable paraffins described above. These alkenes may correspond identically to, and may be obtained directly from polymers, oligomers, or copolymers of hydrocarbons of twelve carbons or less. Such small hydrocarbons include ethylene, propylene, butenes, pentenes, hexenes, etc., and their saturated analogues. An example of a composition that contains such an olefinic compound follows.

EXAMPLE 6

10% by weight of poly(dimethylsiloxane), having a viscosity of 100,000 cs at 100° F, was dissolved in polypropylene, a polymerization product having a flashpoint of 240° F, and a viscosity at −65° F of 433 cs. The solubility parameter of the saturated analogue is 7.6. The resulting composition was homogeneous at −65° F and had viscosities of 1,624 cs and 9.55 cs at −65° F and 210° F respectively.

The naphthenics of the invention do not contain more than one ring; furthermore, it is desirable that the rings contain substituent alkyl groups, and that where said substituent groups exceed four carbons, they must correspond to structures defined above for olefins or isoparaffins. An example of such a material follows.

EXAMPLE 7

10% by weight of poly(dimethylsiloxane) having a viscosity of 100,000 cs at 100° F was dissolved in a cyclohexane started ethylene oligomer having a flashpoint of 190° F, and a viscosity at −65° F of 150 cs. The resulting composition was homogeneous at −65° F and had viscosities of 921.6 cs and 17.1 cs at −65° F and 210° F respectively.

To illustrate the advantage of compositions of the invention over compositions comprising quantities of high molecular weight poly(dimethylsiloxane) and known solvents for low molecular weight poly(dimethylsiloxane), the following examples are offered. It is to be understood that Examples 8–11 are provided for illustrative purposes, and in no way constitute or simulate compositions of the invention.

EXAMPLE 8

Trioctylphosphate and tri-2-ethylhexyl phosphate (trialkyl phosphates employed in U.S. Pat. No. 2,618,601) were combined with 10% by weight of poly(dimethylsiloxane) having a viscosity at 100° F of 100,000 cs. The admixtures were non-homogeneous at temperatures below 75° F. Analogous compositions utilizing poly(dimethylsiloxane) having a viscosity of 10 cs at 100° F were homogeneous at temperatures above −40° F.

EXAMPLE 9

A naphthenic oil, Sunoco Circosol 304, having a pour point of −50° F (i.e. a viscosity at −50° F > 90,000 cs) was combined with 10% by weight of poly(dimethylsiloxane), having a viscosity at 100° F of 100,000 cs. The admixture was observed to separate at temperatures below 40° F.

EXAMPLE 10

Polyisobutylene, of the type described in U.S. Pat. No. 2,446,642, having a flashpoint > 360° F, and viscosity at −65° F > 40,000 cs, was combined with 10% by weight of poly(dimethylsiloxane) having a viscosity at 100° F of 100,000 cs. The admixture became non-homogeneous and separated at temperatures below 20° F.

EXAMPLE 11

A highly refined paraffin oil (Sunpar 106H) having a pour point of 15° F, was combined with 10% by weight of poly(dimethylsiloxane) having a viscosity at 100° F of 100,000 cs. The admixture separated at 75° F.

To illustrate the great improvement in viscosity properties obtained when using poly(dimethylsiloxane) instead of another viscosity improver, the following example is offered for comparison with Example 1.

EXAMPLE 12

Two compositions were prepared using quantities of poly(dimethylsiloxane) having a viscosity at 100° F of 60,000 cs, and a commercial viscosity improver, TLA-407, which when dissolved in Univolt 40 gave initial viscosities which were approximately equal: 9.7 cs and 9.6 cs respectively at 100° C. The viscosities of the same solutions at −67° F were 990 cs and 1,390 cs respectively. The relative difference in viscosity change favours the use of the silicone viscosity improver by a wide margin.

It is a characteristic and great advantage of the compositions of the invention that they are compatible with many common antiwear additives. Wear of system components moving with respect to, and in contact with each other is a serious problem and limits the life and usefulness of all machinery. Thus for lubricating fluids, utilized in environments where other than hydrodynamic lubrication is required, commonly referred to as boundary or extreme pressure lubrication conditions, industry and military specifications have been set on the lubricating, or antiwear, or load bearing properties of the fluid. Under these so-called boundary or extreme pressure conditions, one or more of the components of the lubricant composition interact with each other and/or interact or chemically react with the surfaces to be lubricated to provide the fluid with certain measurable and unique lubricating antiwear, and/or load bearing properties. Numerous examples exist in the literature where so-called lubricity or antiwear additives have been included in lubricant compositions to provide the desired properties. Among the more common antiwear additives are: polyalkyl and polyaryl phosphates such as tricresyl phosphate, organic acids such as adipic acid, various amines, diesters, thiophosphates and thiocarbamates.

In some cases the effectiveness of common lubricity additives is diminished by their interaction with certain components of the fluid. Specifically, it is well documented that fluids containing or comprised of liquid poly(organosiloxanes), particularly poly(dimethylsiloxane), inhibit the action of such lubricity additives; examples include "Antiwear and Antifriction Properties of Poly (organosiloxanes) and Their Mixtures with Hydrocarbons", G.V. Vinogradov et al, Paper No. 64-Lub-8, Transactions of the ASME, 1964; "Influence of Additives on the Antiabrasion and Antifriction Properties of Polysiloxanes", M. I. Nosov and G. V. Vinogradov, Khim i Topliv i Masel, 9 (8), 50-3, (1964); "Effects of Chemically Active Additives on Boundary Lubrication of Steel by Silicones", S. F. Murray, R. L. Johnson, Natl. Advisory Comm. Aeronaut. Tech. Note 3257, (1954). With these fluid compositions, it is necessary to utilize excessive concentrations of antiwear additives or alternatively, to use highly reactive materials to replace common additives in order to provide wear protection meeting common standards. Either of these approaches produce adverse effects, including damaging corrosion and/or decomposition of the other materials contained in the fluid. It is also known that additional problems are encountered when using additives in fluids containing silicone oils. Poly (organosiloxane) molecules are sensitive to the presence of certain chemical functionalities, most notably acids, which act to decompose the silicone molecule. Also, certain additives will cause silicone oil to be precipitated from solution, thereby degrading the properties of the fluid.

We have discovered that the inclusion of selected antiwear additives in the compositions of the invention overcomes the problems outlined above, and that said additives show unexpected and advantageous activity in the presence of silicone oil as found in said compositions. The additives are selected from three general classes, the first being certain metal salts of thiophosphates, corresponding to the general formula:

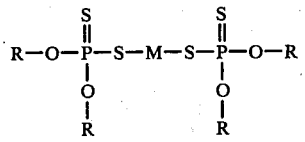

in which R is selected from the group consisting of an alkyl group and an aryl group and M is selected from among cadmium, lead, or zinc. Most preferably, R is an alkyl group of less than 20 carbons, and M is zinc. The compositions contain said thiophosphate salts to the extent that the concentration of the metal in the final formulation is between 0.02 weight percent and 0.5 weight percent, and preferably between 0.06 weight percent and 0.3 weight percent. These compounds are commonly referred to as zinc dialkyl dithiophosphates, and are well known in the industry. Examples of effective dithiophosphate salts available in industry include: Lubrizol 1395, available from Lubrizol Corp.; Elco 116 and Elco 124, available from Elco Corp.; Oloa 267 and Oloa 269 available from the Oronite division of Chevron Chemical Co.; and Hitec E-522, available from Edwin Cooper Inc.

Additionally, it has been discovered that certain metal salts of thiocarbamates are also useful at normal levels in the presence of silicones. These are of the general formula:

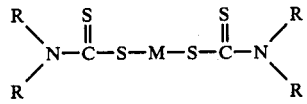

in which R may be an alkyl group, an aryl group, or a hydrogen, and M is either antimony or cadmium. More preferably, R is an alkyl group, and most preferably R is a 5 carbon alkyl group, and M is cadmium.

The compositions contain said thiocarbamate salts in concentrations such that the concentration of the metal in the final formulation is between 0.02 weight percent and 0.5 weight percent, and preferably between 0.06 weight percent and 0.3 weight percent. Examples of effective dithiocarbamate salts available in industry include: Cadmium diamyl dithiocarbamate, marketed as Vanlube 61, and Antimony dialkyl dithiocarbamate marketed as Vanlube 73; both are available from the R. T. Vanderbilt Corp.

Further, for applications where corrosion is required to be negligible, thus precluding the use of sulphur, it has been discovered that, in contrast to the performance of other known organic esters, certain alkyl esters of 4-isopropyl benzoic acid, commonly known as cumic acid, provide excellent antiwear properties when used in conjunction with silicone oils. These esters are of the general formula:

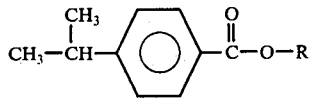

where R is an alkyl group containing from 1 to 10 carbons and preferably from 3 to 5 carbons. Concentrations between 0.1 to 2% by weight, and preferably 0.5 to 1% by weight of the named esters are required in the final formulation to meet rigorous industry specifications.

An example of an effective ester is isobutyl cumate which has the structure:

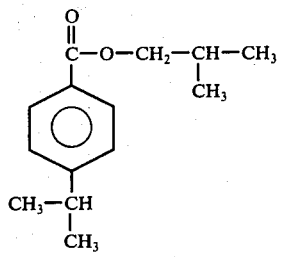

WEAR ADDITIVE PRODUCT PERFORMANCE

Small concentrations of the abovenemed anti-wear additives are effective in maintaining wear at or below common specifications. The wear properties of lubricating fluids are commonly determined with a fourball wear tester. In this test, one steel ball is rotated in the interstice formed by three other immobilized balls immersed in the oil. The wear scars on the three immobilized balls are measured to give an indication of the lubricating properties of the oil. One such test, described in the U.S.A. Military Specification Mil-H-5606-C and commonly utilized by industry to approximate boundary to moderate E.P. conditions, (henceforth referred to as test condition A) is conducted under the following conditions:

| Test Condition A | |
|---|---|
| Temperature | 75° C |
| Speed of Rotation of Ball | 1200 RPM |
| Pressure | 40 kg |
| Time | 1 hour |

The average diameter of the wear scar produced on the three immobilized balls must be less than 1 mm for the lubricating fluid to pass the specification. Examples which follow illustrate the superior performance of antiwear additives of the invention when tested according to test condition A.

EXAMPLE 13

A silicone hydrocarbon composition was formulated as follows:

| | |
|---|---|
| Poly(dimethylsiloxane) 100,000 cs | 10% by weight |
| Esso Univolt 40 | 90% by weight |

This oil was tested in the four-ball tester according to test condition A, and an average scar diameter of 1.16 mm was obtained.

EXAMPLES 14—21

The anti-wear additives were combined with a base oil described in Example 1. Since, with the exception of isobutyl cumate, they are available in industry in dilute form, higher concentrations of the diluted commercial products have been used in a manner consistent with the preceding discussion.

| Example # | Additive | Wt % Blended With Base Oil of Example 12 | Average Wear Scar mm |
|---|---|---|---|
| 14 | Lubrizol 1395 | 5% | .61 |
| 15 | Elco 116 | 5% | .69 |
| 16 | Elco 124 | 5% | .64 |
| 17 | Oloa 267 | 5% | .75 |
| 18 | Oloa 269 | 5% | .64 |
| 19 | Hitec E-522 | 5% | .62 |
| 20 | Vanlube 61 | 5% | .78 |
| 21 | Isobutyl Cumate | 1% | .82 |

EXAMPLES 22–28

The exceptional and surprising performance of the additives of the invention is appreciated by comparing their performance with that of other common additives of the same general class which are shown to be ineffective. Such a comparison is provided by examining the following data, which were obtained from the testing of several common additives under conditions identical to Examples 14 – 21. It is to be understood that the antiwear additives described in Examples 22–28 are not included in the invention.

| Example # | Additive | Wt. % Blended With Base Oil of Example 12 | Average Wear Scar mm |
|---|---|---|---|
| 22 | TCP | 5% | 1.07 |
| 23 | Non-Metallic (Van Lube Thiophosphate 73) | 5% | Weld |
| 24 | Organic Acids Amines | 5% | 1.05 |
| 25 | Zinc Dibutyl Dithiocarbamate | 1% | 1.08 |
| 26 | Amine, Phosphate | 5% | 1.19 |
| 27 | Sulphur (Elco 217) | 5% | 1.01 |
| 28 | Antimony Dialkyl (Oloa Dithiophosphate 254) | 3% | 1.09 |

The concentrations given in Examples 23, 27 and 28 refer to percentages of commercial products rather than pure active ingredient.

A significant aspect of the invention is the apparent complementary action between silicone containing fluids and the antiwear compounds of the invention. Illustrative of this is the positive or neutral effect that antiwear additives of the invention have with respect to the antiwear properties of unimproved solutions of poly(dimethylsiloxane), as described in Example 13. It is well known that solutions of silicone oil show antiwear properties superior to those of either the silicone or the other component and publications describing this synergistic phenomena are plentiful; examples include: "Polysiloxanes as Additives for Increasing the Lubricating Action of Petroleum Oils and Hydrocarbons." M. I. Nosov; Teoriya Smaz. Deistviya i Novye Materialy, Akad. Nauk SSSR; 1965. 68–72. "Antiwear and Antifriction Properties of Poly (organosiloxane)s and their Mixtures with Hydrocarbons." G. V. Vinogradov et al Wear, 8 (12), 92-111, 1965.

The conditions under which this effect occurs are commonly encountered in industry, and they can be approximated by the following four-ball test which is given in the Canadian Government Specification Board, specification 3 GP-59 (henceforth referred to here as test condition B):

| Test Condition B | |
|---|---|
| Temperature | 75° C |
| Speed of Rotating Ball | 600 RPM |
| Pressure | 15 kg |
| Time | 2 hours |

EXAMPLES 29–31

The solution described in Example 13 was prepared and tested along with the individual components, according to test condition B.

| EXAMPLE | COMPOSITION | AVERAGE SCAR DIAM. |
|---|---|---|
| 32 | As described in Example 14 | .34 |
| 33 | As described in Example 15 | .32 |
| 34 | As described in Example 19 | .50 |
| 35 | As described in Example 20 | .40 |

EXAMPLES 32–35

The following examples were tested on the four-ball tester according to test B. Many of the additives of the invention are not designed to improve the lubricating properties under conditions as mild as those of test B (e.g. Numbers 34 and 35), as is seen by the following examples. Such limited usefulness with respect to severity of conditions is common of many materials used by industry for antiwear additives. Nevertheless, it is indicative of their utility in conjunction with silicone, that the additives of this invention do not adversely affect the antiwear action of silicone solutions, whereas other additives do. Comparing the following examples with Example 29 illustrates the neutral or beneficial effects of additives of the invention with regard to silicone induced antiwear scar diameters ≦0.35 mm.

| EXAMPLE # | COMPOSITION | AVERAGE SCAR DIAM. |
|---|---|---|
| 32 | As described in Example 14 | .34 |
| 33 | As described in Example 15 | .32 |
| 34 | As described in Example 19 | .50 |
| 35 | As described in Example 20 | .40 |

EXAMPLES 36–42

The effects of other additives on the antiwear action of silicone solutions tested according to test B show marked contrast to those of the invention (examples 32–35). Note also the deterioration occuring in Examples 36–46 from the results of Example 29. It is to be understood that the antiwear additives described in Examples 36–39 are not part of the invention.

| EXAMPLE # | COMPOSITION | AVERAGE SCAR DIAM. |
|---|---|---|
| 36 | 5% TPSA in blend of Example 13 | .62 |
| 37 | As described in Example 22 | .72 |
| 38 | As described in Example 24 | .98 |
| 39 | 5% organic acids and esters in blend of Example 13 | .75 |
| 40 | As described in Example 23 | .78 |
| 41 | As described in Example 25 | .80 |
| 42 | As described in Example 28 | .88 |

The foregoing examples illustrate the exceptional antiwear performance of lubricating compositions of the invention, including certain antiwear additives. The large wear scars observed for compositions containing common additives other than those of the invention illustrate the unexpected and important improvement realized by compositions of the invention. To qualify silicone containing functional fluids for use under extreme pressure or boundary conditions requires improved performance such as that shown by compositions including antiwear additives of the invention.

It is a further advantage of compositions of the invention that they are compatible with many common additives such as pour point depressants, e.g. low viscosity (<500 cs at 100° F) polydimethylsiloxane, viscosity improvers, e.g. polymethacrylates, oxidation or corrosion inhibitors, and dyes. It is also an advantage of the invention that the compositions may be diluted with materials which would not normally be compatible with dimethyl silicone oil. Such materials might include mineral oils, distillate products, residues of petroleum oils, common synthetic hydrocarbons, alcohols, and other common functional fluids. To illustrate the valuable compatibility characteristics, the following example is offered.

EXAMPLE 43

A composition as described in Example 3 was diluted with 20% by weight of Imperial H-515, a commercial hydraulic fluid. The mixture was compatible. Poly(dimethylsiloxane) having a viscosity of 100,000 cs at 100° F is not miscible in H-515 alone. It is to be understood that the composition described in Example 43 is not a part of the invention.

It is an additional characteristic of compositions of the invention, particularly compositions containing additives, that they are prone to foaming. This foaming is caused by the entrainment and subsequent release of air from the liquid, a phenomenon which frequently occurs in conjunction with vigorous agitation, decompression, or circulation of the lubricant. It is recognized throughout industry that foam in a functional fluid can be highly detrimental to the operation of an automatic transmission or hydraulic device; thus, in order to ensure the commercial utility of compositions of the invention under such conditions, it was desirable to identify a foam controlling additive.

The foaming tendency of many hydrocarbon fluids is controlled by the use of silicone oils, e.g. U.S. Pat. No. 2,416,503, or alternatively by using various halogenated materials, e.g. U.S. Pat. No. 2,394,595, and U.S. Pat. No. 2,515,115, or dispersed metal complexes, or surfactants. However, because the compositions of the invention contain large quantities of silicone oil, their properties are inherently different from those of compositions previously known, and their foaming tendencies are not controlled by the addition of most conventional additives.

It is an additional feature of this invention that a certain species of fluorocarbons, in contrast to the behaviour of other known types of antifoam agents, and in contrast to the behaviour of other well known foam controlling fluorocarbons, has been discovered to be an effective antifoam agent in compositions of the invention.

Specifically, the lubricating compositions may contain a minor foam inhibiting amount of perfluoroalkylpolyether.

More specifically, the compositions as described above may contain from about 1 to 500 parts per million by weight and preferably 5 to 100 parts per million by weight, of a perfluoroalkylpolyether corresponding to the formula:

$$F—[CF(CF_3)CF_2O]_x C_2F_5$$

in which $x$ has a value providing an average molecular weight for the perfluoroalkylpolyether ranging from about 2,000 to 7,000. This molecular weight range will correspond to values for x of about 10 to 41. The preferred perfluoroalkylpolyethers are those in which the average molecular weight ranges from about 2,000 to about 5,500 which molecular weights correspond to values for $x$ of about 11 to 32, respectively. Specific examples of effective perfluoroalkylpolyethers are described below.

EXAMPLE 44

A perfluoroalkylpolyether having the formula:

$$F—[CF(CF_3)CF_2O]_x C_2F_5$$

and having an average molecular weight of 4,500 corresponding to a value for x of about 26. This perfluoroalkylpolyether has a viscosity in centistokes at 100° F of 85 and at 0° F of 6,900, and an approximate boiling range at 0.8 mm. Hg of 440–485° F.

EXAMPLE 45

A perfluoroalkylpolyether having the formula:

$$F—[CF(CF_3)CF_2O]_x C_2F_5$$

and having an average molecular weight of approximately 2,000 corresponding to a value for x of about 11. This perfluoroalkylpolyether has a viscosity in centistokes at 100° F of 18 and at 0° F of 550 and an approximate boiling range at 0.8mm. Hg of 290°–365° F.

EXAMPLE 46

A perfluoroalkylpolyether having the formula:

$$F—[CF(CF_3)CF_2O]_x C_2F_5$$

and having an average molecular weight of about 7,000 corresponding to a value for x of about 41. This perfluoroalkylpolyether has a viscosity in centistokes at 100° F of 495 and at 210° F of 43, and a vapor pressure at 700° F of about 80 mm of Hg.

Commercial products corresponding to this description are Krytox fluids manufactured by E. I. duPont de Nemours & Company.

To illustrate the surprising effectiveness of the perfluoroalkylpolyethers of the invention, the antiform properties of a series of lubricant compositions, both with and without antifoams, were determined in a modified ASTM Foam Test, D-892. According to this test, the foam volume is determined at the end of five (5) minutes blowing with air, and again after standing for an additional ten (10) minutes, the test being conducted at room temperature.

EXAMPLES 47–52

The significance of the presence of dimethyl silicone oil in compositions of the invention is demonstrated by comparing foaming properties of hydrocarbons before and after the addition of said silicone oil. The effectiveness of perfluoroalkylpolyethers of the invention is also unambiguously demonstrated. Results appear in Table I.

EXAMPLES 53–54

The promotion of foaming due to the presence of substantial concentrations of poly (organosiloxanes) as a class is demonstrated by comparing the corresponding data in Table I with that of Examples 47–48. The foam controlling effectiveness of the perfluoroalkylpolyethers of the invention is again demonstrated.

EXAMPLES 55–60

As an illustration of the outstanding and unexpected performance of the antifoams of the invention, they may be compared (especially Example 47) with the performance of various conventional antifoams, and other fluorinated antifoams (shown in these examples). Results appear in Table I. It is understood that the antifoam agents described in Examples 55–60 are presented for comparative purposes, and that said antifoams are not part of the invention.

TABLE 1

| | | | FOAM VOLUME ASTM D892 75° F | | | |
|---|---|---|---|---|---|---|
| | | | WITHOUT ANTIFOAM | | WITH ANTIFOAM | |
| EXAMPLE | COMPOSITION | ANTIFOAM | AFTER 5' AERATION | AFTER 10' SETTLING | AFTER 5' AERATION | AFTER 10' SETTLING |
| Ex. 47 | 10% 100,000 cs dimethylsilicone oil, 90% Univolt 40, as described in Example 13 | 2.5 ppm Krytox AZ, analogous to that described in Example 45 | 400 ml | 20 ml | 30 ml | 0 ml |
| Ex. 48 | Univolt 40 | 10 ppm Krytox AZ | 95 ml | 0 ml | 35 ml | 0 ml |
| Ex. 49 | 25% poly(dimethylsiloxane) (10,000 cs) 75% Univolt 40 | 10 ppm Krytox AZ | 450 ml | 40 ml | 25 ml | 0 ml |
| Ex. 50 | 1% 750,000 cs dimethyl silicone oil, 99% Univolt 40 | 1 ppm Krytox AD, analogous to that described in Example 46 | 200 ml | 0 ml | 140 ml | 0 ml |
| Ex. 51 | As described in Example 47 | 400 ppm Krytox AZ | 400 ml | 20 ml | 0 ml | 0 ml |
| Ex. 52 | As described in Example 47 | 400 ppm Krytox AD | 400 ml | 20 ml | 10 ml | 0 ml |
| Ex. 53 | 50% alkylpolysiloxane, 50% Univolt 40 | 10 ppm Krytox AZ | 170 ml | 5 ml | 35 ml | 0 ml |
| Ex. 54 | 25% poly(phenylmethylsiloxane), 75% Univolt 40 | 10 ppm Krytox AZ | 560 ml | 260 ml | 185 ml | 0 ml |
| Ex. 55 | As described in Example 47 | 142 ppm Pentel 52 (chromium metal complex) | 400 ml | 20 ml | 250 ml | 15 ml |
| Ex. 56 | As described in Example 47 | 112 ppm FC-43 (heptacosafluorotributyl amine) | 400 ml | 20 ml | 345 ml | 0 ml |
| Ex. 57 | As described in Example 47 | 100 ppm 100,000 cs silicone antifoam L-45 | 400 ml | 20 ml | No | No |
| Ex. 58 | As described in Example 47 | 132 ppm FS-1265 (300) (trifluoropropylpolysiloxane) | 400 ml | 20 ml | 175 ml | 0 ml |
| Ex. 59 | As described in Example 47 | 145 ppm FC-170 (fluorosurfactant) | 400 ml | 20 ml | 365 ml | 30 ml |
| Ex. 40 | As described in | 93 ppm Monflor 71 (fluorosurfactant) | 400 ml | 20 ml | 120 ml | 30 ml |

The foregoing examples illustrate the exceptional foam resistant tendencies of compositions of the invention containing the perfluoroalkylpolyether antifoam additive of the invention. This outstanding improvement over other foam controlled compositions is essential to quality compositions of the invention for certain rigorous applications.

In the industry, it is common practice to disperse antifoam agents such as perfluoroalkylpolyethers in foaming fluids by first dissolving the said antifoam additives in solvents which are themselves soluble in the foaming fluids (e.g. U.S. Pat. No. 3,775,324). A useful, very fine dispersion of the antifoam is thus obtained. The only known hydrocarbon oil soluble solvents for the perfluoroalkylpolyethers of the invention are poly- or per-halocarbons such as trichlorotrifluoroethane. However, it has been shown by M. Z. Fainman ("Halogenated Solvents and Corrosion in Dynamic Systems" Lubrication Engineering, pp. 556–558, November 1974.) that a parts per million concentration of such halocarbons can cause grave corrosion problems in certain applications such as hydraulic systems.

It is an additional aspect of this invention that we have discovered an alternative method of dispersing perfluoroalkylpolyethers in compositions containing silicone and hydrocarbons, as previously described. Specifically, a fine dispersion of a minor portion of said perfluoroalkylpolyethers can be achieved and maintained in poly(dimethylsiloxanes) having a viscosity at 100° F less than 500 cs, and greater than 5 cs. These silicone oil/antifoam compositions can then be added to the lubricating compositions of the invention in the minute quantities required to provide a highly dispersed foam inhibiting perfluoroalkylpolyether concentration between 1 and 500 ppm. This is illustrated by the following example.

EXAMPLE 61

198 grams of poly(dimethylsiloxane) having a viscosity of 50 cs at 100° F were agitated in a household type blender while 2 grams of Krytox 143 AZ, a perfluoroalkylpolyether as described in Example 44, were added dropwise. The resultant 1% emulsion was stable for more than 24 hours, and was added with stirring to compositions of the invention, as in Examples 47 through 54 in quantities to give the concentrations of perfluoroalkylpolyether indicated. As seen by the foam test results, the method of dispersion is effective.

The foregoing data and discussion serve to reveal the exceptional properties and characteristics of functional fluid compositions containing high molecular weight silicone oil, and in some cases specific and surprisingly effective additives for the control of wear and foaming tendencies. For use in extreme and rigorous environments, functional fluids are required which possess properties such as those exhibited by composition of the invention. As a final illustration of such a composition the following example is presented.

EXAMPLE 62

To a composition containing 10% by weight poly (dimethylsiloxane), (100,000 cs) and 90% by weight Esso Univolt 40, was added: 2% by weight of Elco 116, 7.9 ppm Krytox AZ, 1% by weight of an oxidation inhibitor; and a minor concentration of coloring dye. The resulting composition was homogeneous at −65° F, and had viscosities of 2,241 cs and 10.19 cs at −65° F and 210° F respectively. The formulation gave good wear properties on a Shell four-ball wear test, and performed outstandingly when run in a Vickers type V-104-A hydraulic pump for 40 hours under high pressure conditions.

The specific details of the compositions described with reference to the above examples are for the purpose of illustrating the invention. Modification in the incidental features and details of the composition including the addition of other additives for specific functions can be made without departing from the spirit and scope of the applicants invention.

Van Lube is a trade mark of R. T. Vanderbilt Inc.
Elco is a trade mark of Elco Corporation.
Oloa is a trade mark of Chevron Corporation.

END OF SPECIFICATION

The embodiments of the invention in which an exclusive property or privilege is claimed are defined as follows:

1. A lubricating oil composition comprising a homogeneous mixture of from 1% to 50% by weight of (A) poly(dimethylsiloxane) having the general formula:

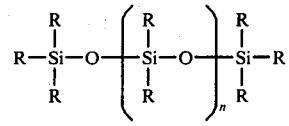

when R is a methyl group in essentially all cases and n has a value such that the average viscosity of the poly(dimethylsiloxane) at 100° F is between 10,000 cs and 1,000,000 cs, and the remainder of said mixture consisting of (B) hydrocarbon oil having a viscosity of less than 40,000 cs at −65° F, and a flashpoint higher than 175° F, and said hydrocarbon oil being at least one selected from the group consisting of (a) alkenes, (b) isoparaffins, and (c) naphthenics having a single ring which has multiple alkyl substituents; in the case of (a) and (b), the longest carbon chain, and in the case of (c) any alkyl substituent in which the longest carbon chain exceeds five carbon atoms, has multiple substituent alkyl branches, and its methyl branched homolog has a solubility parameter of less than 7.84 and said substituent alkyl branches of four or more carbon atoms are themselves branched, and where at least 50% of said substituent alkyl branches are bonded to carbons of the longest carbon chain which are immediately adjacent, or separated by only one carbon atom.

2. A composition as claimed in claim 1 comprising a minor amount of an antiwear additive (C) selected from the group consisting of (1) metal salts of thiophosphates corresponding to the formula:

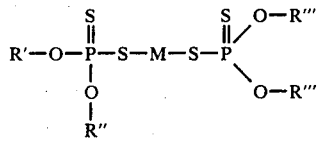

in which each of R′, R″, R‴ and R⁗ is one selected from the group consisting of an alkyl group and an aryl group and M is one selected from the group consisting of cadmium, lead, and zinc; (2) metal salts of thiocarbamates corresponding to the formula:

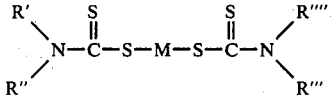

in which each of R′, R″, R‴ and R⁗ is one selected from the group consisting of an alkyl group and an aryl group and M is one selected from the group consisting of antimony and cadmium; and (3) esters of 4-isopropyl benzoic acid, commonly known as cumic acid, corresponding to the formula:

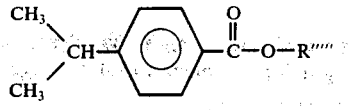

where R''''' is an alkyl group; wherein the proportion of component (C), is sufficient to give antiwear properties to the composition.

3. A composition as claimed in claim 1 containing a minor amount of (D) perfluoroalkylpolyether corresponding to the formula:

$$F—[CF(CF_3)CF_2O]_x C_2F_5$$

in which $x$ has a value providing an average molecular weight for the perfluoroalkylpolyether ranging from about 2,000 to 7,000, wherein the amount of (D) in said composition is from 1 to about 500 ppm, by weight of the total composition.

4. A composition as claimed in claim 1 where the longest linear segments of the hydrocarbon oil have no substituent alkyl branches which exceed two carbons in length, and where n has values such that the viscosity of the poly(dimethylsiloxone) at 100° F is between 10,000 cs and 50,000 cs.

5. A composition as claimed in claim 2 where the longest linear segments of the hydrocarbon oil have no substituent alkyl branches which exceed two carbons in length, and where n has values such that the viscosity of the poly(dimethylsiloxone) at 100° F is between 10,000 cs and 50,000 cs.

6. A composition as claimed in claim 3 where the longest linear segments of the hydrocarbon oil have no substituent alkyl branches which exceed two carbons in length, and where n has values such that the viscosity of the poly(dimethylsiloxone) at 100° F is between 10,000 cs and 50,000 cs.

7. A composition as claimed in claim 1 wherein said hydrocarbon oil is one selected from the group consisting of iso-paraffin and alkene, and wherein the amount of component (a) in said mixture is from 5% to 30% by weight.

8. A composition as claimed in claim 7 wherein said hydrocarbon oil is nephthenic.

9. A composition as claimed in claim 2 wherein said hydrocarbon oil is one selected from the group consisting of iso-paraffin and alkene, and wherein the amount of component (A) in said mixture is from 5% to 30% by weight.

10. A composition as claimed in claim 9 wherein said hydrocarbon oil is nephthenic.

11. A composition as claimed in claim 3 wherein said hydrocarbon oil is one selected from the group consisting of iso-paraffin and alkene, and wherein the amount of component (A) in said mixture is from 5% to 30% by weight.

12. A composition as claimed in claim 11 wherein said hydrocarbon oil is nephthenic.

13. A composition as claimed in claim 1 wherein the hydrocarbon oils (B) are saturated or unsaturated copolymers of hydrocarbons selected from the group consisting of 2, 3 and 4 carbon atoms.

14. A composition as claimed in claim 2 wherein the hydrocarbon oils (B) are saturated or unsaturated copolymers of hydrocarbons selected from the group consisting of 2, 3 and 4 carbon atoms.

15. A composition as claimed in claim 3 wherein the hydrocarbon oils (B) are saturated or unsaturated copolymers of hydrocarbons selected from the group consisting of 2, 3, and 4 carbon atoms.

16. A composition as claimed in claim 1 wherein the hydrocarbon oils (B) are saturated and unsaturated copolymers of propylene and iso-butylene.

17. A composition as claimed in claim 2 wherein the hydrocarbon oils (B) are saturated and unsaturated copolymers of propylene and iso-butylene.

18. A composition as claimed in claim 3 wherein the hydrocarbon oils (B) are saturated and unsaturated copolymers of propylene and iso-butylene.

19. A composition as claimed in claim 1 wherein the hydrocarbon oils (B) are saturated or unsaturated polymers of propylene.

20. A composition as claimed in claim 2 wherein the hydrocarbon oils (B) are saturated or unsaturated polymers of propylene.

21. A composition as claimed in claim 3 wherein the hydrocarbon oils (B) are saturated and unsaturated polymers of propylene.

22. A composition as claimed in claim 2 where (C) is (1), a metal salt of thiophosphate wherein M is zinc and wherein R', R'', R''', R'''' are alkyl groups of no more than 18 carbons, and wherein the proportion of component (C) ranges from a concentration such that the weight percent of zinc is about 0.02% of the total composition to a concentration of (C) such that the weight percent of zinc is about 0.5% of the total composition.

23. A composition as defined in claim 2 where (C) is (2), a metal salt of thiocarbamate wherein R', R'', R''', R'''' are alkyl groups of no more than 18 carbons each, and wherein the proportion of component (C) ranges from a concentration such that the weight percent of M is about 0.02% of the total composition to a concentration of (C) such that the weight percent of M is about 0.5% of the total composition.

24. A composition as defined in claim 2 where (C) is (3), an ester of cumic acid, wherein R''''' is an alkyl group of no more than 10 carbons, and wherein the proportion of (C) ranges from about 0.1 weight percent to about 2 weight percent of the total composition.

25. A composition as defined in claim 24 wherein R''''' is an isobutyl group.

26. A composition as defined in claim 3 wherein x has a value which provides an average molecular weight for the perfluoroalkylpolyether ranging from about 2,000 to 5,500 and wherein the proportion of (D) ranges from about 5 to about 10 parts per million by weight of the total composition.

27. A composition as claimed in claim 2 containing a minor amount of (D) perfluoroalkyl-polyether corresponding to the formula:

$$F—[CF(CF_3)CF_2O]_x C_2F_5$$

in which x has a value providing an average molecular weight for the perfluoroalkylpolyether ranging from about 2,000 to 7,000 and wherein the amount of (D) in said composition is from 1 to about 500 ppm by weight of the total composition.

28. A composition as claimed in claim 27 wherein x has a value providing an average molecular weight for the perfluoroalkylpolyether ranging from about 2,000 to 5,500 and wherein the proportion amount of (D) in said composition is from about 5 to about 100 parts per million by weight of the total composition.

29. A lubricating oil composition comprising a hydrocarbon oil, from 1% to 50% by weight of the total composition of poly(organosiloxane) and from 1 to 500 parts per million of the total composition of perfluoroalkylpolyether corresponding to the formula:

$$F—[CF(CF_3)CF_2O]_x C_2F_5$$

in which x has a value which provides an average molecular weight for the perfluoroalkylpolyether ranging from about 2,000 to 7,000.

* * * * *

UNITED STATES PATENT OFFICE
CERTIFICATE OF CORRECTION

Patent No. 4,059,534 Dated November 22, 1977

Inventor(s) W. C. Morro, L. E. Hakka, J. M. Brophy, J-C Courtes, M.Hebrard

It is certified that error appears in the above-identified patent and that said Letters Patent are hereby corrected as shown below:

Column 10, lines 31 to 39 inclusive, delete:

| EXAMPLE | COMPOSITION | AVERAGE SCAR DIAM. |
|---|---|---|
| 32 | As described in Example 14 | .34 |
| 33 | As described in Example 15 | .32 |
| 34 | As described in Example 19 | .50 |
| 35 | As described in Example 20 | .40 |

and substitute the following:

| EXAMPLE | DESCRIPTION | AVERAGE SCAR DIAM. |
|---|---|---|
| 29 | Solution described in Example 1 | .48 |
| 30 | Univolt 40 | .82 |
| 31 | Poly(dimethylsiloxane) | weld |

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*